US007411094B2

(12) United States Patent
Griesbach et al.

(10) Patent No.: US 7,411,094 B2
(45) Date of Patent: Aug. 12, 2008

(54) METHOD FOR THE PRODUCTION OF PRIMARY AMINES COMPRISING A PRIMARY AMINO GROUP WHICH BOUND TO AN ALIPHATIC OR CYCLOALIPHATIC C-ATOM, AND A CYCLOPROPYL UNIT

(75) Inventors: Ulrich Griesbach, Mannheim (DE); Harald Winsel, Birkenheide (DE); Hermann Putter, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 36 days.

(21) Appl. No.: 11/571,625

(22) PCT Filed: Jul. 8, 2005

(86) PCT No.: PCT/EP2005/007400

§ 371 (c)(1), (2), (4) Date: Jan. 4, 2007

(87) PCT Pub. No.: WO2006/005531

PCT Pub. Date: Jan. 19, 2006

(65) Prior Publication Data

US 2008/0064901 A1 Mar. 13, 2008

(30) Foreign Application Priority Data

Jul. 13, 2004 (DE) ..... 10 2004 033 718

(51) Int. Cl.
*C07C 209/40* (2006.01)

(52) U.S. Cl. ..... 564/448

(58) Field of Classification Search ..... None
See application file for complete search history.

(56) References Cited

FOREIGN PATENT DOCUMENTS

EP 1 036 863 9/2000

OTHER PUBLICATIONS

Ayyaswami, N. et al., "Behaviour of oximes at a nickel black cathode", Journal of Applied Electrochemistry, vol. 14, No. 4, pp. 557-559, 1984.

Prasad, Brij M. et al., "Electrochemical Reduction of Ketoximes of some Cycloalkanones and 1,2-Diones", J Indian Chem. Soc., vol. 68, pp. 95-97, 1991.

*Primary Examiner*—Brian J Davis
(74) *Attorney, Agent, or Firm*—Oblon, Spivak, McClelland, Maier & Neustadt, P.C.

(57) ABSTRACT

Process for preparing primary amines having a cyclopropyl unit and a primary amino group bound to an aliphatic or cycloaliphatic carbon atom (amine A) by cathodically reducing oximes having a cyclopropyl unit or oxime derivatives in which the hydrogen atom in the oxime group has been replaced by an alkyl or acyl group (oxime O) at a temperature of from 50 to 100° C. in an essentially anhydrous electrolyte solution in a divided electrolysis cell.

8 Claims, No Drawings

METHOD FOR THE PRODUCTION OF PRIMARY AMINES COMPRISING A PRIMARY AMINO GROUP WHICH BOUND TO AN ALIPHATIC OR CYCLOALIPHATIC C-ATOM, AND A CYCLOPROPYL UNIT

The present invention relates to a process for preparing primary amines having a cyclopropyl unit and a primary amino group bound to an aliphatic or cycloaliphatic carbon atom.

The preparation of primary amines by electrochemical reduction of oximes having no further functional groups is known from J. Indian Chem, Soc. 1991, 68, 95-97 Here, a liquid mercury cathode is used and the electrolyte is cooled to about 5° C. However, in the preparation of primary amines containing cyclopropyl units from the corresponding oximes, it was found that undesirable by-products are formed in addition to the desired product under these conditions when relatively low reaction temperatures are employed. A person skilled in the art would expect that the formation of undesirable by-products would tend to increase at relatively high reaction temperatures, since it is a generally recognized basic rule that the selectivity of a reaction decreases with increasing temperature and the formation of by-products is thus promoted.

It was therefore an object of the present invention to provide a process by means of which the amines defined above can be prepared electrochemically in high yields.

We have accordingly found a process for preparing primary amines having a cyclopropyl unit and a primary amino group bound to an aliphatic or cycloaliphatic carbon atom (amine A), in which oximes having a cyclopropyl unit or oxime derivatives in which the hydrogen atom in the oxime group has been replaced by an alkyl or acyl group (oxime O) are cathodically reduced at a temperature of from 50 to 100° C. in an anhydrous electrolyte solution in a divided electrolysis cell.

The process is particularly suitable for preparing amines A which are compounds of the general formula $H_2N—CHR_1R_2$ (formula I), where $R^1$ is hydrogen, $C_3$-$C_8$-cycloalkyl, $C_1$-$C_{20}$-alkyl. $C_6$-$C_{20}$-aryl or together with $R^2$ and the methine group located between $R^1$ and $R^2$ forms a $C_5$-$C_6$-cycloalkyl group, with the abovementioned hydrocarbon radicals being able to be substituted by $C_1$-$C_6$-alkoxy or halogen, and $R^2$ is $C_3$-$C_8$-cycloalkyl, $C_1$-$C_{20}$-alkyl $C_6$-$C_{20}$-aryl or together with $R^2$ and the methine group located between $R^1$ and $R^2$ forms a $C_5$-$C_6$-cycloalkyl group, with the abovementioned hydrocarbon radicals being able to be substituted by $C_1$-$C_6$-alkoxy, $NH_2$—, $C_1$-$C_{20}$-alkylamino or halogen, with the proviso that at least one of the radicals $R^1$ and $R^2$ is cyclopropyl or is substituted by cyclopropyl. Oximes O used as starting materials for preparing the amines A of the general formula I are compounds of the general formula $R_5O—N=CR_3C_4$ (formula II), where $R^3$ has the same meaning as $R^1$ in formula I, $R^4$ has the same meaning as $R^2$ in formula I and the radicals $R^3$ and $R^4$ may be substituted by 1-hydroxyimino($C_1$-$C_{20}$) alkyl radicals, 1-$C_1$-$C_6$-alkoxy)imino($C_1$-$C_{20}$)alkyl radicals or 1-($C_1$-$C_6$-acyloxy)imino($C_1$-$C_{20}$)alkyl radicals and $R^5$ is hydrogen, $C_1$-$C_6$-alkyl or $C_1$-$C_6$-acyl.

The process of the invention is very particularly suitable for preparing amines A of the general formula Ia Ia

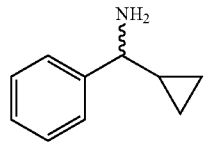

in which the phenyl ring may be substituted by halogen atoms or $C_1$-$C_4$-alkoxy groups.

Starting materials used for the amines A of the formula Ia are the corresponding oximes O of the general formula IIa, (IIa)

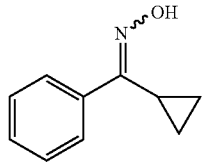

where the phenyl ring may be substituted by halogen atoms or $C_1$-$C_4$-alkoxy groups.

The catholyte may, if appropriate, comprise not only an amine A formed in the course of the reaction and an oxime O but also a solvent. Solvents used as the inert solvents generally customary in organic chemistry, e.g. dimethyl carbonate, propylene carbonate, tetrahydrofuran, dimethoxyethane, acetonitrile or dimethylformamide, Preference is given to using a $C_1$-$C_4$-alkyl alcohol as solvent. $C_5$-$C_7$-Hydrocarbons such as hexane are also suitable as solvents in combination with the solvents mentioned.

To make the catholyte conductive, it generally further comprises a mineral acid, preferably sulfuric acid or an alkali metal ($C_1$-$C_4$)alkoxide, preferably sodium methoxide.

In general, an electrolyte salt is added to the anolyte and if appropriate, also to the catholyte (in addition to one of the abovementioned contactivity-inducing agents). This is generally an alkali metal salt or a tetra($C_1$-$C_6$-alkyl)ammonium salt, preferably a tri($C_1$-$C_6$-alkyl)methylammonium salt. Possible counterions are sulfate, hydrogensulfate, alkylsulfates, arylsulfates, halides, phosphates, carbonates, alkylphosphates, alkylcarbonates, nitrate, alkoxides, tetrafluoroborate, hexafluorophosphate or perchlorate.

Preference is given to methyltributylammonium methylsulfate (MTBS), methyltriethylammonium methylsulfate or methyltripropylmethylammonium methylsulfate.

The water content of the catholyte and anolyte is generally less than 2% by weight, preferably less than 1% by weight, particularly preferably less than 0.5% by weight. It has to be taken into account that water is formed in stoichiometric amounts in the reduction of the oxime O to the amine A. If the process is carried out batchwise using a sufficiently high dilution of the starting material and the catholyte and anolyte have a water content of less than 0.1% by weight at the beginning of the reaction, it is generally superfluous to remove water formed during the reaction from the electrolyte. Otherwise, the water content of the electrolyte can be reduced by customary methods, e.g. by distillation.

The process of the invention can be carried out in all customary types of divided electrolysis cells, in order to prevent starting materials and/or products from undergoing secondary chemical reactions as a result of the cathode process in the process of the invention. The process is preferably carried out continuously in divided flow-through cells.

Divided cells having a parallel arrangement of flat electrodes are preferably used. The cells can be divided by ion exchange membranes, microporous membranes, diaphragms, filter cloths made of materials which do not conduct electrons, glass frits and porous ceramics. Preference is given to using ion exchange membranes, in particular cation exchange membranes. These conductive membranes are commercially available, e.g. under the trade names Nafion® (E.T. DuPont de Nemours and Company) and Gore Select® (W. L. Gore & Associates, Inc.).

Cathodes used are preferably ones in which the cathode surface is formed by a material having a high hydrogen overvoltage, e.g. lead, zinc, tin, nickel, mercury, cadmium, copper or alloys of these metals or glassy carbon, graphite or diamond.

Particular preference is given to diamond electrodes as described, for example, in EP-A-1036863.

As anodes, it is in principle possible to use all customary materials, preferably those also mentioned as cathode materials. Platinum, diamond, glassy carbon or graphite anodes are preferably used in an acid anolyte. If the anolyte is basic, preference is given to using stainless steel.

The anode reaction can be chosen freely; preference is given to oxidizing the $C_1$-$C_4$-alcohol used as solvent there. When methanol is used, methyl formate, formaldehyde dimethyl acetal or dimethyl carbonate is formed. A sulfuric acid solution diluted with a $C_1$-$C_4$-alcohol is, for example, employed for this purpose.

The current densities at which the process is carried out are generally from 1 to 1000 mA/cm$^2$, preferably from 10 to 100 mA/cm$^2$. The process is generally carried out at atmospheric pressure. Higher pressures are preferably employed when the process is to be carried out at relatively high temperatures in order to prevent boiling of the starting compounds or solvents.

After the reaction is complete, the electrolyte solution is worked up by generally known separation methods, For this purpose, the catholyte is generally first distilled and the individual compounds are obtained separately in the form of various fractions. Further purification can be carried out, for example, by crystallization, distillation or chromatography.

Experimental Part

EXAMPLE 1

| | |
|---|---|
| Apparatus: | Electrolysis unit with catholyte and anolyte circuits and two divided electrolysis cells connected in series |
| Anode: | 2 graphite anodes, effective area of each; 300 cm$^2$ |
| Cathode: | 2 lead cathodes, effective area of each: 300 cm$^2$ |
| Membrane: | Proton-conducting perfluorinated membrane having sulfonic acid groups, e.g. Nafion 324 from DuPont |
| Distance between electrode and membrane: | 6 mm |
| Current density: | 3.4 A/dm$^2$ |
| Voltage: | 20-40 V |
| Temperature: | 55° C. |
| Composition of anolyte: | 979.2 g of MeOH, 20.8 g of $H_2SO_4$, 96% strength |
| Composition of catholyte: | 5000 g of MeOH, 400 g of sodium methoxide solution, 30% in MeOH, 600 g of cyclopropylphenylmethanone oxime 1 |
| Flow rate: | 150-200 L/h |

In the electrolysis under the conditions indicated, anolyte and catholyte were pumped through the respective half cells for 24 hours (corresponds to an amount of charge of 5 F/mol of 1). Analysis of the reaction product mixture by gas chromatography indicated 95.1% by area of the desired product 2, 0.10% of the ring-opened compound 3, 0.82% of starting material 1 and 3.18% of high boilers.

1

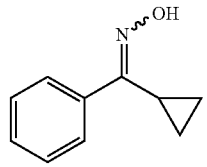

2

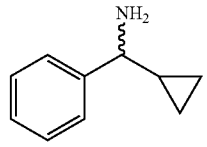

3

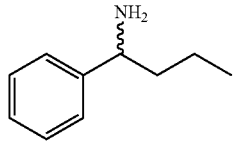

EXAMPLE 2

| | |
|---|---|
| Apparatus: | Electrolysis cell with catholyte and anolyte circuits |
| Anode: | Graphite, effective area: 35 cm$^2$ |
| Cathode: | Lead, effective area: 35 cm$^2$ |
| Membrane | Proton-conducting perfluorinated membrane having sulfonic acid groups, e.g. Nafion 117 from DuPont |
| Current density: | 3.4 A/dm$^2$ |
| Voltage: | 15-20 V |
| Temperature: | 40° C. |
| Composition of anolyte: | 117.5 g of MeOH, 25 g of $H_2SO_4$, 96% strength |
| Composition of catholyte: | 94.0 g of MeOH, 1.0 g of $H_2SO_4$, 96% strength, 5 g of cyclopropylphenylmethanone oxime 1 |

In the electrolysis under the conditions indicated, anolyte and catholyte were pumped through the respective half cells for 4.11 hours (corresponds to an amount of charge of 6 F/mol of 1). Analysis of the reaction product mixture by gas chromatography indicated 83.3% by area of the desired product 2, 1.3% of the ring-opened compound 3, and 15.6% of high and intermediate boilers.

EXAMPLE 3

For Comparison

| | |
|---|---|
| Apparatus: | Electrolysis cell with catholyte and anolyte circuits |
| Anode: | Graphite, effective area: 300 cm$^2$ |
| Cathode: | Lead, effective area: 300 cm$^2$ |
| Membrane | Proton-conducting perfluorinated membrane having sulfonic acid groups, e.g. Nafion 324 from DuPont |
| Current density: | 3.4 A/dm$^2$ |

-continued

| | |
|---|---|
| Voltage: | 14-33 V |
| Temperature: | 40° C. |
| Composition of anolyte: | 783 g of MeOH, 17 g of $H_2SO_4$, 96% strength |
| Composition of catholyte: | 2600 g of MeOH, 100 g of NaOMe, 30% strength in MeOH, 300 g of cyclopropylphenylmethanone oxime 1 |

In the electrolysis under the conditions indicated, anolyte and catholyte were pumped through the respective half cells for 27.6 hours (corresponds to an amount of charge of 6.5 F/mol of 1). Analysis of the reaction product mixture by gas chromatography indicated 77.3% by area of the desired product 2, 2.0% of unreacted oxime 1 and 20.7% of high and intermediate boilers.

The invention claimed is:

1. A process for preparing primary amines having a cyclopropyl unit and a primary amino group bound to an aliphatic or cycloaliphatic carbon atom (amine A) by cathodicallly reducing oximes having a cyclopropyl unit or oxime derivatives in which the hydrogen atom in the oxime group has been replaced by alkyl or acyl group (oxime O) at a temperature of from 50 to 100° C. in an essentially anhydrous electrolyte solution in a divided electrolysis cell.

2. The process according to claim 1, wherein the amines A are compounds of the general formula $H_2N—CHR_1R_2$ (formula I), where $R^1$ is hydrogen, $C_3$-$C_8$-cycloalkyl, $C_1$-$C_{20}$-alkyl, $C_6$-$C_{20}$-aryl or together with $R^2$ and the methine group located between $R^1$ and $R^2$ forms a $C_5$-$C_6$-cycloalkyl group, with the abovementioned hydrocarbon radicals being able to be substituted by $C_1$-$C_6$-alkoxy or halogen, and $R^2$ is $C_3$-$C_8$-cycloalkyl, $C_1$-$C_{20}$-alkyl, $C_6$-$C_{20}$-aryl or together with $R^2$ and the methine group located between $R^1$ and $R^2$ forms a $C_5$-$C_6$-cycloalkyl group, with the abovementioned hydrocarbon radicals being able to be substituted by $C_1$-$C_6$-alkoxy, $NH_2$—, $C_1$-$C_{20}$-alkylamino or halogen, with the proviso that at least one of the radicals $R^1$ and $R^2$ is cyclopropyl or is substituted by cyclopropyl, and the oxides O are compounds of the general formula $R_5O—N=CR_3R_4$ (formula II), where $R^3$ has the same meaning as $R^1$ in formula I, $R^4$ has the same meaning as $R^2$ in formula I and the radicals $R^3$ and $R^4$ may be substituted by 1-hydroxyimino($C_1$-$C_{20}$)alkyl radicals, 1-($C_1$-$C_6$-alkoxy)imino($C_1$-$C_{20}$)alkyl radicals or 1-($C_1$-$C_6$-acyloxy)imino($C_1$-$C_{20}$)alkyl radicals and $R^5$ is hydrogen, $C_1$-$C_6$-alkyl or $C_1$-$C_6$-acyl.

3. The process according to claim 1, wherein the amines A are compounds of the general formula Ia, (Ia)

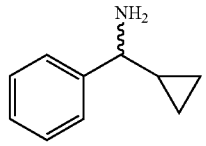

in which the phenyl ring may be substituted by halogen atoms or $C_1$-$C_4$-alkoxy groups and the oximes O are compounds of the general formula IIa, (IIa)

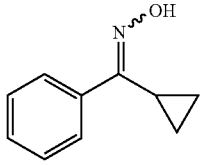

in which the phenyl ring may be substituted by halogen atoms or $C_1$-$C_4$-alkoxy groups.

4. The process according to claim 1, wherein the catholyte comprises an amine A and an oxime O and also a $C_1$-$C_4$-alkyl alcohol as solvent.

5. The process according to claim 1, wherein the catholyte comprises a mineral acid or an alkali metal $C_1$-($C_4$)alkoxide.

6. The process according to claim 1, wherein the cathode surface is formed by a material having a high hydrogen overvoltage.

7. The process according to claim 1, wherein the cathode surface is formed by lead, zinc, tin, nickel, mercury, cadmium, copper or alloys of these metals or glassy carbon, graphite or diamond.

8. The process according to claim 1, wherein the water content of the catholyte is less than 2% by weight.

* * * * *